United States Patent [19]

Garnett

[11] 4,345,789

[45] Aug. 24, 1982

[54] CARRYING DEVICE FOR CYLINDRICAL TANKS

[75] Inventor: Lawrence C. Garnett, Unionville, Canada

[73] Assignee: Enpoco Limited, Canada

[21] Appl. No.: 202,198

[22] Filed: Oct. 30, 1980

[51] Int. Cl.[3] ..... B65D 63/18

[52] U.S. Cl. ..... 294/31.2; 294/165

[58] Field of Search ..... 294/15, 31.2, 137, 146, 294/141–143, 165–169; 16/114 R; 137/355.16; 215/100 A; 248/76, 79, 83, 89, 313, 316 D

[56] References Cited

U.S. PATENT DOCUMENTS

| | | | |
|---|---|---|---|
| 1,337,518 | 4/1920 | Kelly | 294/31.2 |
| 2,344,513 | 3/1944 | Mapes | 248/313 |
| 2,434,655 | 1/1948 | Homer | 294/169 |
| 2,725,208 | 11/1955 | Bova | 248/89 |
| 2,757,958 | 8/1956 | Bussey et al. | 248/79 X |
| 3,310,270 | 3/1967 | Ciancio | 248/313 X |
| 3,817,435 | 6/1974 | DeLuca et al. | 294/165 |
| 3,820,696 | 6/1974 | Gongolewski | 294/165 X |

*Primary Examiner*—Johnny D. Cherry

*Attorney, Agent, or Firm*—Murray & Whisenhunt

[57] ABSTRACT

A carrying device for a cylindrical tank includes a band which may be placed around the tank and tightened to grip the outer surface. A holder is provided on the band to receive a torch connected to the tank by a hose. The hose is stored on a cleat attached to the band so that a compact carrying arrangement is obtained. The cleat also provides a pair of spaced support surfaces which support the tank on its side in a stable position for storage. The holder enables the torch to be held in a fixed location during use so that the operator has both hands available for manipulation of the work piece.

6 Claims, 6 Drawing Figures

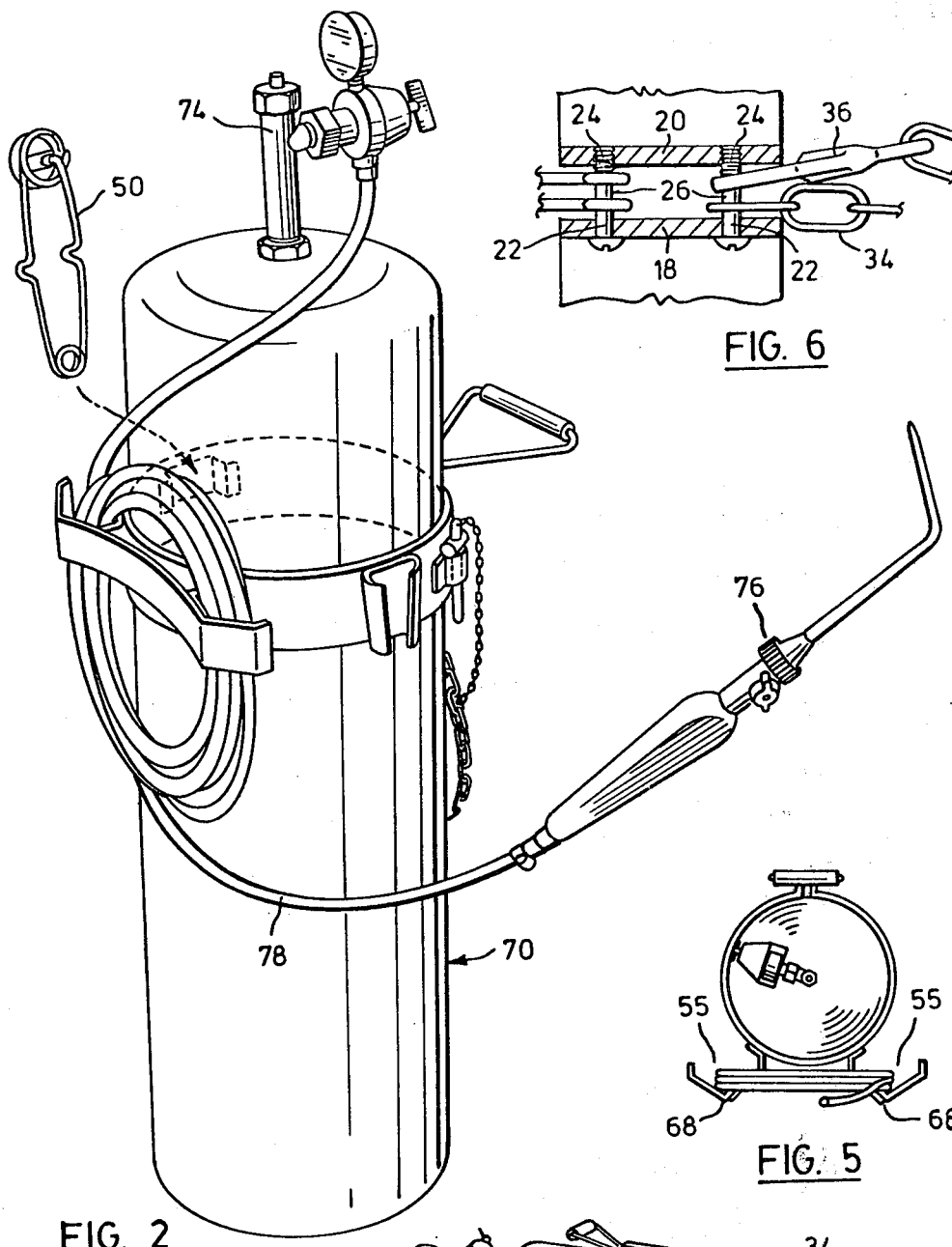
FIG. 2
FIG. 6
FIG. 5
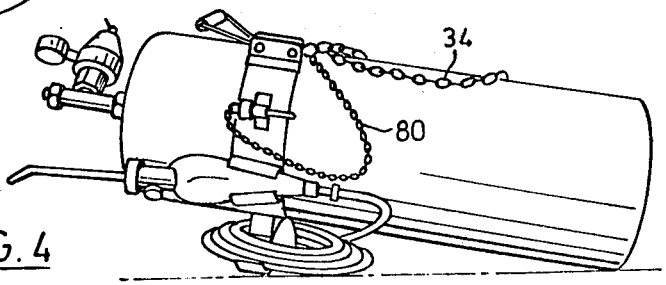
FIG. 4

CARRYING DEVICE FOR CYLINDRICAL TANKS

The present invention relates to carrying devices for tanks, and in particular to detachable carrying devices for tanks commonly used in brazing, welding, or the like.

It is common practice to provide a high temperature heat source for welding, brazing or soldering by burning a gas, such as acetylene, in a controlled manner by means of a torch. The gas is usually stored in a tank under pressure and connected to the torch by a pressure regulator and a hose. The tanks are usually cylindrical and comparatively cumbersome. It is not practical to provide a carrying handle integral with the tank because the tank is essentially a pressure vessel. Therefore, the tanks have been either carried bodily or mounted on trucks and wheeled between work sites. Neither of these solutions is practical when, as frequently occurs, the work sites are on different levels so there is therefore a need for a simple carrying device that permits the tank to be carried and moved in a convenient manner.

A further hazard in moving such tanks is the hose connecting the torch and the tank. This is usually quite long and so may snag other objects during movement of the tank causing the operator to stumble or trip. Alternatively, the operator must grasp both the tank and hose which presents a further encumberance.

A further problem with the tanks as presently used is their stability during storage. The tanks stand upright on their base during use and so are inherently unstable. It is desirable to store the tanks in a stable position but if they are laid on their sides, due to their cylindrical nature they roll which is undesirable in a work site environment.

The present invention seeks to overcome these disadvantages by providing a tank carrying device in the form of a band which may be placed around the tank. Connecting means are provided to pull the band into gripping engagement with the tank surface. A handle is pivotally connected to the band to provide a convenient carrying point and a holder is mounted on the band to receive the torch and detachably secure it to the band. Thus the tank may be carried from place to place by the handle and the torch secured in a convenient location relative to the tank. This enables the operator to carry the tank and torch in one hand and facilitates movement between work sites.

To store the hose, a cleat is mounted on the band so that the hose may be wound around the cleat and stored in a convenient manner. The cleat is provided with a pair of support surfaces which are sufficiently spaced from the surface of the tank to provide a stable support when the tank is laid on its side.

An embodiment of the invention will now be described by way of example only with reference to the accompanying drawings in which:

FIG. 2 is a perspective view showing a tank carrier attached to a tank.

FIG. 4 is a side elevation showing a tank with a carrier attached lying on its side.

FIG. 5 is a view in the direction of arrow V of FIG. 4.

FIG. 6 is a section on the line 6—6 of FIG. 4.

Figure 1:
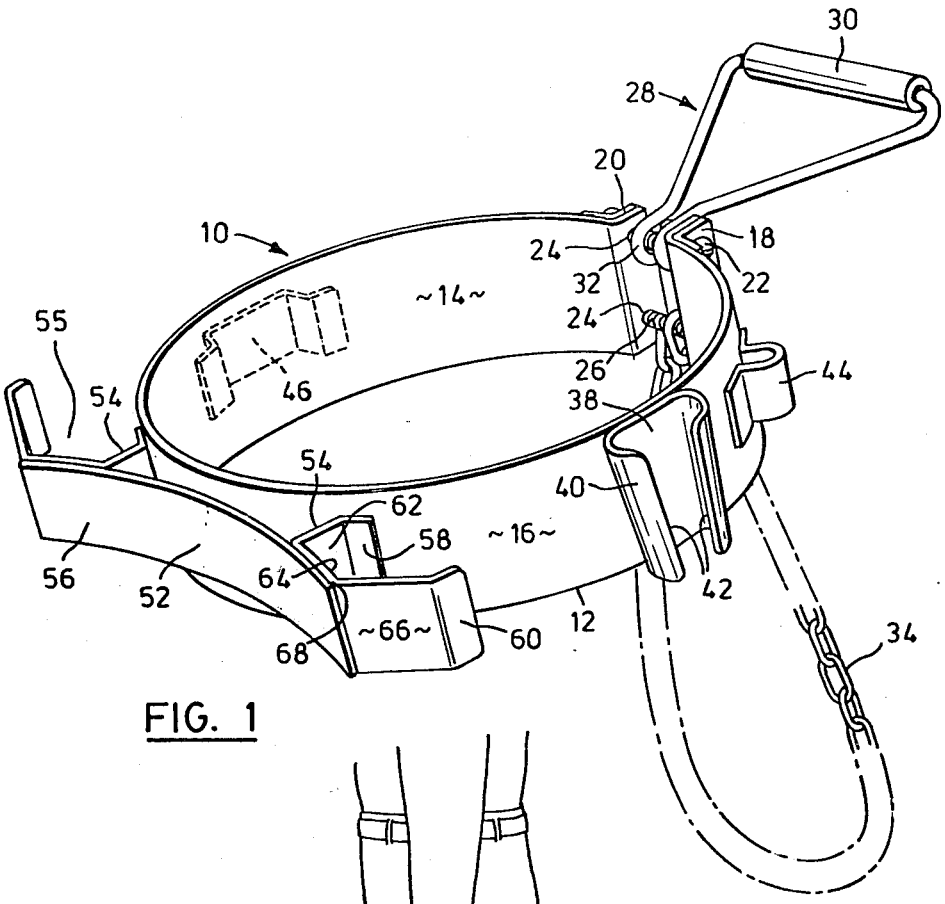
FIG. 1 is a perspective view showing a tank carrier.

Referring now to the drawings, a tank carrier 10 comprises a band 12 having an inner surface 14 and an outer surface 16. Each end of the band 12 is turned outwardly to provide a pair of spaced flanges 18, 20. A pair of holes 22 is provided in the flange 18 in alignment with a pair of threaded holes 24 in the flange 20. The flanges 18, 20 are connected by two screws 26 which pass freely through the holes 22 and are threaded into the holes 24. By rotating the screw 26, the flanges 18, 20 may be moved relative to one another to adjust the diameter of the band 12.

A handle 28 is formed from a wire which is bent into a generally triangular shape with a tube 30 located on one side. The ends of the wire are bent into loops 32 which pass snugly around one of the screws 26 to pivotally connect the handle 28 and the band 12.

A safety chain 34 is connected to the carrier 10 by passing the other screw 26 through a link in the chains 34. A clip 36 is provided on the other end of the chain 34 so that the chain 34 may be detached, looped around a fixed object and reattached to the screw 26.

A torch holder 38 is spot welded to the outer surface 16 of the band 12. The holder 38 is formed from sheet material which is bent at its edges 40 to define a pair of converging bights 42. The edges 40 are spaced from one another a sufficient distance to permit a hose to pass between them. A pair of loops 44, 46 formed from strip material are spot welded to the outer surface 16 to receive a valve wrench 48 and a sparker 50, and hold them in a convenient position for transportation.

A cleat 52 is also welded to the outer surface 16 and includes a pair of spaced legs 54 interconnected by a bridge member 56. Each of the legs 54 is bent from a strip material to have an inner flange 58, and a terminal flange 60 interconnected by three angularly disposed webs 62, 64, 66. The inner flange 58 is spot welded to the outer surface 16 so that the webs 62 of each leg 54 are generally parallel to one another and the legs 54 define oppositely facing openings 55. The bridge member 56 is curved and is positioned so as to touch the band 12 intermediate the legs 54 to permit it to be spot welded to the outer surface 16. Opposite ends of the bridge member 56 are welded to the webs 64 of respective legs 54 so that the bridge member acts as a brace between the legs 54 and the outer surface 16. The intersection of the webs 64 and 66 provides a support surface 68 which is spaced sufficiently from the outer surface 16 that with both support surfaces abutting a horizontal surface the portion of the band 12 between the legs 54 is above the horizontal surface. The legs 54 therefore provide a pair of spaced support surfaces that support the carrier 10 in a stable position.

The carrier 10 is intended for use with a pressurized tank 70 which is generally cylindrical and has an outer surface 72. The tank 70 is vented through a pressure regulator 74 which is connected to a torch 76 by a length of hose 78.

The carrier 10 is attached to the tank 70 by rotating the screws 26 to permit the flanges 18, 20 to move apart until the band 12 is of greater diameter than the tank 70. The band is then slipped along the tank so that it is positioned just above the centre of gravity of the tank 70. The screws 26 are tightened to bring the flanges 18, 20 together so that the inner surface 14 grips the outer wall 72 of the tank 70. The hose 78 is coiled around the cleat 52 and held within the openings 55 by the webs 62, 64, 66. The torch 76 may then be secured in the holder 38 by slipping the hose 78 between the edges 40 and sliding the torch between the bights 42. The convergence of the bights 42 is chosen to correspond with the taper of the body of the torch 76 so that it is snugly received in the holder 38 with the edges 42 overlying the body. The wrench 48 and sparker 50 are placed within the loops 44, 46 respectively and a retaining chain 80 is provided to secure the wrench to the band.

Figure 3:
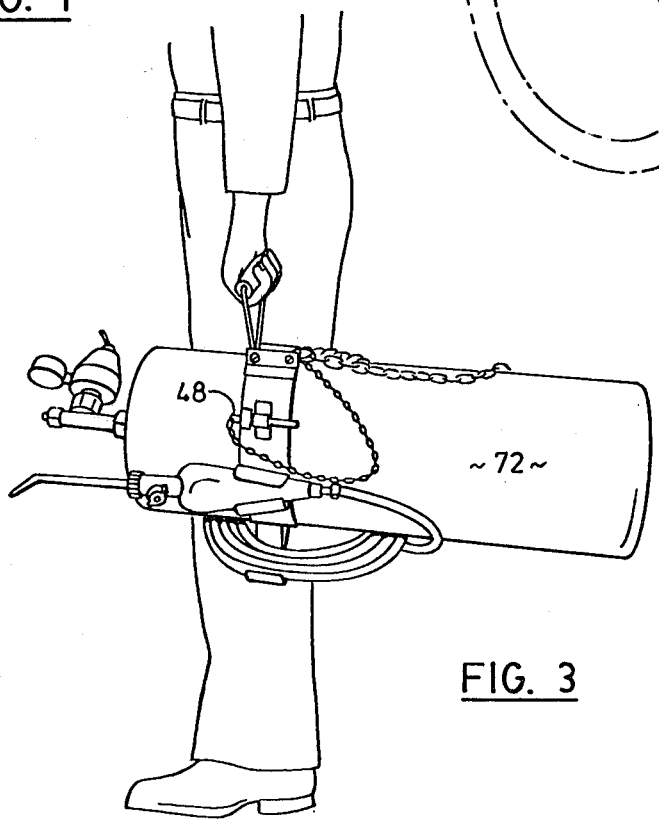
FIG. 3 is a side elevation showing a tank with the carrier of FIG. 1 attached and being carried by an operator.

With the carrier 10 arranged in the manner described above, an operator may carry the tank 70, hose 78 and torch 76 in a convenient compact manner from location to location. The tank 70 will lie in a generally horizontal position from the handle 28, as illustrated in FIG. 3, and enables the operator to carry the tank with one hand. Because the torch and hose are secured to the carrier, the danger of snagging other objects is avoided.

When the operator wishes to use the torch 76, the tank 70 is placed in an upright position and the torch 76 removed from the holder 38 together with the desired length of hose from the cleat 52.

Alternatively, the torch 76 may be left in the holder 38 with the tank 70 in an upright position. The torch 76 is then held in a fixed position so that the operator has both hands free to manipulate the workpiece.

The tank may be laid in a stable position by placing it in a generally horizontal position with the support surfaces 68 engaging the floor, as shown in FIGS. 4 and 5. The lower periphery of the tank 70 also abuts the floor so that a stable three point support is provided. The spacing of the support surfaces 68 ensures that the band 12 does not contact the floor between the legs 54 and prevents rocking movement of the tank 70. It will also be noted that hose on the cleat does not interfere with the stability of the tank since it is held within the openings 55 above the support surfaces 68.

When the tank 70 is empty, the carrier 10 may be removed by loosening the screws 26, removing the pressure regulator 74 and sliding the band along the outer surface 72.

It will be seen therefore that a simple device is provided that permits movement of the tank, torch and hose between locations in a convenient manner, permits carrying in one hand and provides stability for the tank when it is in use.

What we claim as our invention is:

1. A detachable carrying device for use with a tank having a torch connected thereto by a flexible hose, said carrying device comprising a band formed to extend around at least a portion of said tank and having an inner surface engageable therewith, connecting means acting between spaced locations on said band and operable to cause relative movement therebetween to move said inner surface into engagement with said tank, a carrying handle connected to said band at one side of said band and a cleat attached to said band at the opposite side of said band and spaced from said spaced locations to provide a storage facility for said hose independent of the operation of said connecting means, said cleat having a pair of support surfaces spaced outwardly from said band to provide a stable position for said tank when supported on said support surfaces.

2. A carrying device according to claim 1 wherein said cleat includes a pair of legs spaced apart on said band and extending outwardly therefrom, said legs including said support surfaces.

3. A carrying device according to claim 2 wherein a brace extends between each leg and said band.

4. A carrying device according to claim 1 including a holder mounted on said band to receive and support said torch.

5. A carrying device according to claim 1, including means for pivotally connecting said carrying handle to said band.

6. A carrying device as claimed in claim 1, further comprising sparker means for igniting said torch and means on said band for releasably securing said sparker means to said band.

* * * * *